US005964117A

United States Patent [19]

Holroyd et al.

[11] Patent Number: 5,964,117

[45] Date of Patent: Oct. 12, 1999

[54] BACKWARD EXTRUSION METHOD AND PRODUCT

[75] Inventors: Nigel John Henry Holroyd, Riverside, Calif.; John Terence Evans, Newcastle-upon-Tyne, United Kingdom; Robert Arthur Cudney, Riverside, Calif.

[73] Assignee: Luxfer Group Limited, Manchester, United Kingdom

[21] Appl. No.: 08/817,695

[22] PCT Filed: Oct. 13, 1995

[86] PCT No.: PCT/GB95/02426

§ 371 Date: May 30, 1997

§ 102(e) Date: May 30, 1997

[87] PCT Pub. No.: WO96/11757

PCT Pub. Date: Apr. 25, 1996

[30] Foreign Application Priority Data

Oct. 13, 1994 [EP] European Pat. Off. ..... 94307508

[51] Int. Cl.[6] ..... B21C 23/22

[52] U.S. Cl. ..... 72/258; 72/267; 72/379.4

[58] Field of Search ..... 72/253.1, 258, 72/267, 256, 352, 358, 359, 379.4

[56] References Cited

U.S. PATENT DOCUMENTS

| | | | |
|---|---|---|---|
| 3,184,945 | 5/1965 | Hornak et al. | 72/267 |
| 3,648,351 | 3/1972 | Kibler . | |
| 4,078,508 | 3/1978 | Schertenleib | 72/258 |
| 4,876,868 | 10/1989 | Tushaus et al. | 72/267 |

FOREIGN PATENT DOCUMENTS

| | | | |
|---|---|---|---|
| 2395794 | 1/1979 | France | 72/267 |
| 57-25218 | 2/1982 | Japan | 72/267 |
| 59-54441 | 3/1984 | Japan | 72/258 |
| 633633 | 11/1978 | U.S.S.R. | 72/258 |
| 1937875 | 8/1966 | United Kingdom . | |

OTHER PUBLICATIONS

Patent Abstracts of Japan, vol. 7 No. 55 (M–198), Mar. 5, 1983 & JPA57202916.

Patent Abstracts of Japan, vol. 4 No. 179 (M–046), Dec. 11, 1980 & JP A55 128315.

Patent Abstracts of Japan, vol. 13, No. 425 (M–873) Sep. 21, 1989 & JP A 01162536.

Patent Abstracts of Japan, vol. 18 No. 302 (M–1618), Jun. 9, 1994 & JP A 06 063681.

*Primary Examiner*—Joseph J. Hail, III
*Assistant Examiner*—Ed Tolan
*Attorney, Agent, or Firm*—Nixon & Vanderhye P.C.

[57] ABSTRACT

A method of forming a closed-end vessel by backward extrusion comprises providing an extrusion billet having a front surface with an axial recess and a body of an extrudable material positioned in the recess. Backward extrusion results in the formation of a closed-ended vessel, for example a pressurized gas cylinder, composed of the material of the extrusion billet with a weld bonded inner surface lining of the extrudable material.

10 Claims, 2 Drawing Sheets

BACKWARD EXTRUSION METHOD AND PRODUCT

BACKGROUND OF THE INVENTION

1. Field of the Invention

This invention concerns composite closed-end vessels, and their production by backward extrusion.

2. Discussion of Prior Art

The technique of backward extrusion involves the use of a generally cylindrical container with parallel side walls, and a ram to enter the container dimensioned to leave a gap between itself and the side walls equal to the desired thickness of the extrudate. An extrusion billet is positioned in the container. The ram is driven into a forward face of the billet and effects extrusion of the desired hollow body in a backwards direction. The forward motion of the ram stops at a distance from the bottom of the container equal to the desired thickness of the base of the extruded hollow body. Extrusion speed, the speed at which the extrudate exits from the container, is not critical but is typically in the range 50–500 cm/min. Lubrication can substantially reduce the extrusion pressure required.

SUMMARY OF THE INVENTION

In one aspect, this invention concerns a development of this technique. The invention provides a backward extrusion method for forming a closed-ended vessel which comprises providing, in a container for backward extrusion, a billet of a first extrudable metal, said billet having an axis and a forward face, and driving a ram along the axis into the forward face of the billet, wherein the forward face of the billet is made with an axial recess and a body of a second extrudable material is provided in the recess, whereby there is formed a closed-ended vessel composed of the first extrudable material with an adherent inner surface lining of the second extrudable material.

In another aspect, the invention provides a pressurised gas container formed by backward extrusion, which container is composed of an aluminium alloy and carries a weld bonded inner surface lining of an extrudable material.

BRIEF DESCRIPTION OF THE DRAWINGS

Reference is directed to the accompanying drawings in which.

DETAILED DESCRIPTION OF THE PREFERRED EMBODIMENTS

Figure 1:
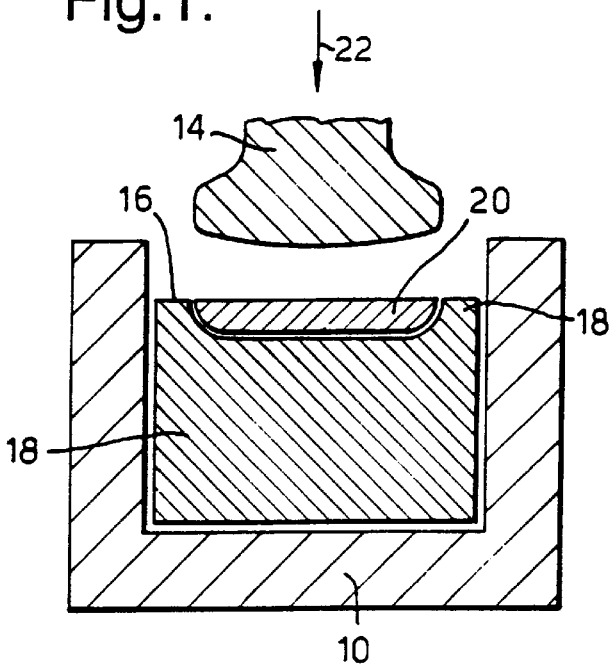
FIGS. 1 and 2 are sectional side elevations of backward extrusion equipment according to the invention at different stages in the backward extrusion process.

Referring to FIG. 1, backward extrusion equipment comprises a container 10 having cylindrical side walls to contain an extrusion billet 12, and a ram 14. The extrusion billet has a front face 16 provided with a shallow axial recess defined by a rim 18 surrounding the recess. A body 20 of a second extrudable material is provided in the recess. The ram is mounted for reciprocation in a direction 22 along the axis of the extrusion billet and the container.

Figure 2:
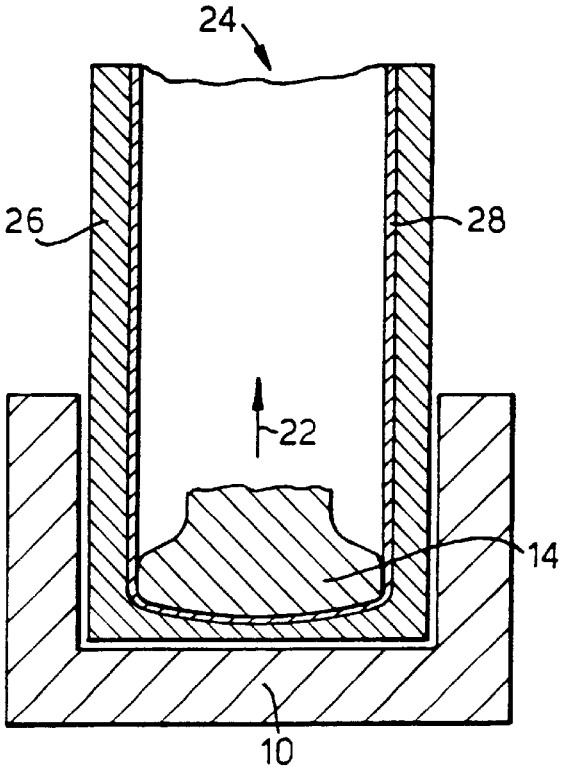

FIG. 2 shows the position after the ram has been driven into the forward face of the extrusion billet. There has been formed by backward extrusion a closed-ended vessel 24 having cylindrical side walls. The vessel is composed of the first extrudable metal 26, derived from the billet 12, with a weld bonded inner surface lining of the second extrudable material 28 derived from the body 20.

If a cylindrical extrusion billet of first material had been placed in the container, and a disc of the second material placed on top of it, then the backward extrusion operation would have resulted in a closed-ended vessel in which the second material was concentrated at the forward end of the cylindrical wall, with little or none forming an interior lining at the closed backward end. To avoid this, the extrusion billet 12 is formed with an axial recess in its forward face, with the body of the second material being positioned in that recess. Preferably no part of the body of the second material stands proud of the extrusion billet. Preferably the extrusion billet includes an annular part which surrounds and extends forward of the recess in which the body of the second material is provided. Preferably the diameter of the axial recess in the forward face of the extrusion billet is substantially equal to the diameter of the ram. These features can be used to ensure that the first and second materials are co-extruded from the start, and in particular that the second material is not extruded prior to the first one.

Preferably the body of the second extrudable material is shrink-fitted in a correspondingly shaped recess in the top surface of the extrusion billet. Thus a cold body of second material may be inserted into a corresponding recess in a hot extrusion billet, which then cools and contracts round the body. This shrink-fitting arrangement has advantages: a) the interfacial region between the billet and the body is maintained free from lubricant ingress, and b) the shrink-fitting process establishes a local residual stress pattern that favours the initiation of co-extrusion at the start of the back-extrusion process.

The process of backward extrusion results in the formation of a closed-ended vessel composed of the first extrudable material with a weld bonded inner surface lining of the second extrudable material. The weld bonding is a metallurgical bond that results from the backward extrusion process; for example, deposition of metal by electrolytic or other means would result in a lining but not one weld bonded to the substrate. The lining may be present on the entire inner surface of the closed-ended vessel. Alternatively, the lining may be present only at the closed end and on the cylindrical side wall adjacent the closed end. Control over this may be achieved by controlling the shape and depth of the recess into which the body of the second material is inserted prior to extrusion.

The extrusion billet is of a first extrudable material which is preferably a metal for example an aluminium alloy. Conventional extrudable Al alloys, such as those from the 2000, 6000 and 7000 series of the Aluminum Association Inc Register, are suitable.

Provided in a recess on that extrusion billet is a body, e.g. a sheet, disc, slab or block of a second extrudable material, preferably one which is more extrudable than the first. This material may be selected from a wide range in order to impart desired surface properties to the extrudate. For example it may be an extrudable metal of different composition to the extrusion billet e.g. Al or Ni or a different Al alloy when the extrusion billet is of an Al alloy; or an organic polymer, or a metal matrix composite. If this material would cause damage on contact with the extrusion equipment, it may be sheathed or otherwise protected so as to prevent such contact.

The backward extrusion process may be performed with the extrusion billet preferably cold or warm, or even hot. The extrusion conditions are not material to this invention, and conventional conditions may be used.

For simplicity, the invention has hitherto been described on the basis that only two different materials are co-extruded. But of course bodies of many different materials may be provided overlying one another in the extrusion container, so as to obtain a composite extrudate in which the walls comprise layers of the many different materials.

This invention thus provides a route to generate multi-layer laminated extruded structures offering unique combinations of properties, for example:

Low or high weight to stiffness and/or volume ratios,

Outstanding toughness and fatigue crack growth resistance,

Controllability of fracture modes,

Internal surface layers with specific properties,

All by a low-cost production route.

The invention allows use of materials in back-extruded products that are:

a) Incompatible with direct contact with the extrusion punch-nose but can offer beneficial properties. Thus for example, metal matrix composites (MMC) would promote excessive punch-nose wear during extrusion but would provide high specific stiffness in products. Problems with extrudate materials being incompatible with the extrusion container or sleeve can be overcome by placing the extrusion billet sections within a suitable thin walled tube.

b) Too chemically reactive for long-term exposure to the envisaged service environment but offer desirable properties in the final product, e.g. specific strength, stiffness and toughness. (Special steps may be needed to overcome problems associated with exposed laminate material at the open end of the extruded shell).

c) Outside the chemical composition ranges of current alloy specifications. This should permit the utilisation of recycled scrap alloy.

d) Beneficial to a structure but deficient in at least one property pre-requisite for a particular application.

Design and fabrication of safe and weight efficient high pressure gas containment systems impose very demanding material property requirements, almost inevitably resulting in at least one property having to be compromised to allow achievement of the required property balance. The above invention offers a method to minimise these material selection restrictions thereby allowing the fabrication of novel systems tailored to provide specific properties, for example:

a) Internal surfaces can be engineered to be inert or re-active in a particular combination of gas, liquid and solid phases.

Some manufacturers currently market high pressure gas containers formed by backward extrusion of an excess-silicon alloy designated 6351. They would like to move to a balanced alloy 6061. But some customers are resistant to this move, because they believe that a minor copper addition in 6061 may have a detrimental influence on the long term gas stability provided by aluminium high-pressure gas cylinders. This concern (real or imaginary) can be addressed by means of this invention by providing an internal cladding of an Al alloy of different composition overlying the whole of the internal wall and end surfaces of the container.

b) Outer and/or sandwich layers with desirable properties (e.g. high stiffness, wear resistance, strength, etc. from a MMC) can be provided by materials that would have caused unacceptable tool wear during extrusion. This is achieved by using a billet top-sheet to prevent punch-nose contact with the abrasive material during backward extrusion.

c) Chemically reactive materials offering a particularly desirable property can be sandwiched between layers providing adequate resistance to chemical attach, e.g. lithium rich Al—Li based alloys, magnesium based alloys or aluminium scrap alloys containing unusually high levels of iron, silicon and/or a combination of other alloying elements.

d) A suitable designed laminated structure can significantly improve both the fracture and fatigue performance of a high pressure gas cylinders as it is possible to include layer(s) with specific properties and to introduce boundary interfaces ensuring that cracks initiating in one layer will be blunted at laminate boundary with significant reduction of the stress intensity promoting crack propagation. In the case of the fatigue of gas cylinders it is envisaged that the use of appropriate laminated structures will markedly improve cylinder performance, because crack initiation and growth resistances are generally controlled by the performance of material at the internal knuckle-radius of the cylinder base to wall transition region which will be readily modified using multi-layer extrusion billets during backward extrusion.

EXAMPLE 1

An experimental run was performed with the object of extruding two different aluminium alloys at the same time. The extrusion billet was of a 7XXX alloy and on top of that was provided a disc of 1100 aluminium.

Two slugs were extruded detailed as follows:

1. The first extrusion goal was to yield a 7XXX shell with a wall of 104 mm mean with an 1100 inner liner of 0.25 mm thickness.

Results: There was some deformation at the opening of the cup followed by what appears to be a continuous lining of 1100 aluminium throughout the inside of the 7XXX shell.

2. The second extrusion goal was to yield a 7XXX shell with a wall of 101 mm mean with an 1100 inner liner of 0.50 mm thickness.

Results; The end of the cup shattered upon impact of the ram, but the cup completed extrusion. It appears there is a lining throughout the length of the 7XXX shell.

In both cases the liner thickness tapers from approximately 0.10 mm at the open end to less than 0.025 mm or 0.05 mm at the base end.

EXAMPLE 2

Figure 3:
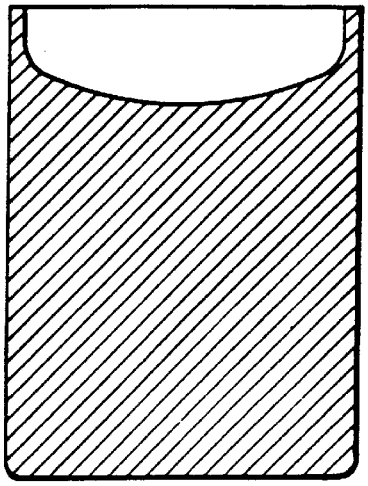
FIGS. 3 and 4 are sectional side elevations of extrusion billets, each having a forward face with an axial recess therein.

An experimental run was performed with the object of extruding two different aluminium alloys at the same time. The main extrusion billet was a 7000 series alloy (Al; 6% Zn; 2% Mg; 2% Cu; 0.2% Cr). The insert material was commercially pure aluminium sheet (1100). The extrusion billet is shown in FIG. 3. This is a cylindrical billet 20 cm diameter and 25 cm long. In the forward face (top in the drawing) a torispherical recess is machined of shape corresponding to the shape of the ram. The diameter of the recess is 18.04 cm and the depth of the recess is 5.375 cm.

Figure 5:
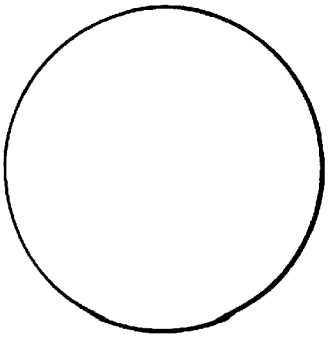
FIGS. 5 and 6 are plan and side elevations of a body of a second extrudable material to be provided in the recess.
Figure 6:
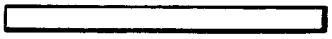

The insert is shown in FIGS. 5 and 6. This is a disc 18.02 cm diameter and either 0.625 or 1.250 cm thick.

The 7000 extrusion billet surfaces (other than the recess) were lubricated using a stearate based paste, and a disc of the insert material was placed in the machined recess and its outer surface lubricated.

During the initial stages of extrusion, while the 1100 flat sheet was deforming to the shape of the 7xxx series billet's machined profile, it was found that an air-pocket was trapped between the two alloys and a loud noise resulted when extrusion process eventually forced the air to escape to the atmosphere. It was also observed that the 1100 alloy extruded to some degree prior to the two alloys co-extruding. This effect was more pronounced for the thicker 1100 inserts and this accounts for why the 1100 thickness on the internal surfaces of the extruded shells were independent of insert thickness.

The approximately 100 cm long cylindrical shells (wall thickness 10.7 mm) formed by backward extrusion, resembled those formed when monolithic billets are extruded, save that in this case the 7xxx series alloy shells were lined with a thin layer of commercially pure aluminium. The 1100 alloy layer thickness was tapered, being thickest (0.1 mm) at the start of the extrusion, i.e. the open-end of the shell and the thinnest (0.025–0.05 mm) at the closed-end, which was formed at the end of the extrusion. The internal surface finish of the cylindrical shells was excellent, resembling that of a dull mirror. The surface condition was superior to that typically produced when 7xxx or 6xxx series alloys are back-extruded under similar conditions. Metallographic examination of the shell walls confirmed that a metallurgical bond had been created between the 7xxx and 1100 alloys during co-extrusion for all regions other than towards the open-end of the extrusion, which formed during the early stages of the extrusion. This is consistent with lubricant and trapped air being present in the interfacial region between the 1100 alloy plate insert and the 7xxx series billet at the start of the extrusion process.

EXAMPLE 3

Figure 4:
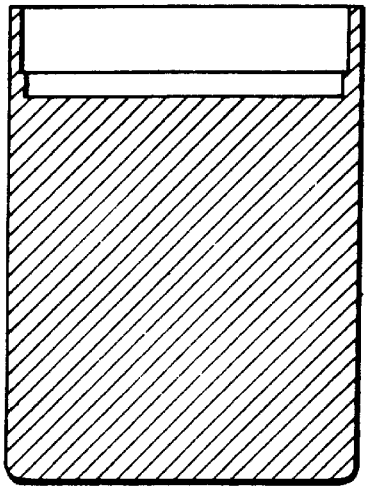

The extrusion billets used in this further trial were as shown in FIG. 4. Each 6061 billet was pre-machined with a axial 5 cm deep recess comprising a 18.44 cm diameter flat-base hole with a slightly smaller diameter flat-base hole in its base. The depth of the smaller hole was 0.125 cm greater than the thickness of the 1100 disc employed in the extrusion trial as an insert.

The 1100 alloy discs were inserted in two ways, one involving the discs being machined to size and simply placed into position while the other involved shrink-fitting slightly oversized diameter discs into the 6061 billets by inserting discs into pre-heated (150° C.) 6061 ingot recesses. Prior to back-extrusion the billets were lubricated using a stearate based product.

TABLE 1

1100 alloy disc and machined recess sizes for extrusion trials

| Disc Location | Disc Diameter (cm) | Machined Recess Diameter (cm) | Disk Thickness (cm) |
|---|---|---|---|
| As-Machined | 17.95 | 17.96 | 0.625 |
| | 18.02 | 18.04 | 1.25 |
| Shrink-Fit | 17.95 | 17.92 | 0.625 |
| | 18.02 | 18.00 | 1.25 |

Although all the variants evaluated yielded approximately 100 cm long co-extruded 6061 extruded shells with a thin layer of 1100 alloy on the internal wall surfaces, the shrink-fitted discs consistently gave a superior result.

For the shrink-fit case:

a) Co-extrusion of the two alloys initiated immediately at the start of backward extrusion with the 1100 alloy layer being flush with the 6061 and
b) the 1100 layer was continuous along the entire length of the shell and had a polished "mirror" finish.

Results for the as-machined fitted discs were less reproducible. The 1100 alloy layer had a dull appearance and there was often evidence of poor adhesion between the 6061 and the 1100 layers with blisters occurring due to air being trapped between the two alloys. In addition, unlike for the shrink-fit case, the 1100 material always started to extrude prior to co-extrusion conditions being established. In some instances, particularly when 1.25 cm thick 1100 inserts were used, high percentages of the 1100 was extruded prematurely, thereby being unavailable for co-extrusion.

The main reasons why the shrink-fitted inserts give a superior result are:

a) the interfacial region between the 6061 billet and the 1100 alloy insert are maintained free from lubricant ingress and
b) the shrink-fitting process establishes a local residual stress pattern that favours the initiation of co-extrusion at the start of the back-extrusion process.

As expected the 1100 alloy layers produced during co-extrusion were tapered, being thickest at the open of the shell and thinnest at the closed-end. Continuous 1100 alloy layers were found on the closed-end of all the shells produced, independent of the 1100 disk thickness or insertion method involved. In the case of shells formed from the billets with as-machined fitted insert disks, although these 1100 alloy layers were extremely thin, they were readily recognisable in the shell base regions because of the local surface blistering characteristics.

The open ends of co-extruded shells formed from two 6061 billets with shrunk-fitted 0.625 cm thick 1100 alloy discs were hot swaged to form the crown region of high pressure gas cylinders. This process involved cropping the open-end of the shell by 10–12 cm, annealing the remaining first 15–20 cm of shells open-end at 450° C. for a few seconds prior to hot swaging the end in a heading die at the same temperature to form a cylinder crown. Subsequent metallographic examination of these cylinders revealed that the hot swaging process had not degraded the coherence between the 6061 and 1100 alloys and that 6061 high pressure aluminium alloy gas cylinders with a continuous internal surface layer of commercially pure aluminium alloy 1100 may be fabricated by the method outlined in this example.

We claim:

1. A backward extrusion method for forming a closed-ended vessel for use as a high pressure gas container which comprises providing, in a container for backward extrusion, a billet of a first extrudable metal, said billet having an axis and a forward face, lubricating the billet, and driving a ram along the axis into the forward face of the billet, wherein the forward face of the billet is made with an axial recess and a body of a second extrudable metal is provided in the recess so as to exclude lubricant from the interface between said first extrudable metal and said second extrudable metal, whereby there is formed a closed-ended vessel composed of the first extrudable metal with an adherent inner surface lining of the second extrudable metal.

2. A method as claimed in claim 1, wherein said step of providing said second extrudable metal in said recess comprises the step of shrink-fitting said second extrudable metal in said recess in the top surface of the billet.

3. A method as claimed in claim 1, wherein the billet of the first extrudable metal includes an annular part which surrounds and extends forward of the recess in which the body of the second extrudable metal is provided.

4. A method as claimed in claim 1, wherein the ram has a diameter substantially equal to the diameter of the axial recess in the forward face of the billet.

5. A method as claimed in claim 1, wherein the first extrudable metal is an aluminium alloy.

6. A method as claimed in claim 1, wherein the body of a second extrudable metal is a metal disc.

7. A method as claimed in claim 1, wherein the adherent inner surface lining of the second extrudable metal is present on the entire inner surface of the closed-ended vessel.

8. A backward extrusion method for forming a closed-ended vessel, said method comprising the steps of:

providing a billet of a first extrudable metal in a container for backward extrusion, said billet having an axis and a forward face, said billet having an axial recess in said forward face;

locating a body of a second extrudable metal in said recess so as to seal any space between said first and second extrudable metals from any subsequently applied extrusion lubricant;

lubricating said billet with an extrusion lubricant; and backward extruding said billet and said second extrudable metal so as to provide said closed end vessel.

9. A method as claimed in claim 8, wherein said step of locating said second extrudable metal into said recess comprises the step of shrink-fitting said second extrudable metal into said recess.

10. A method as claimed in claim 8, wherein said second extrudable metal does not extend into a plane including the forward face of the first extrudable metal.

* * * * *